US010260752B2

(12) United States Patent
LeBegue et al.

(10) Patent No.: US 10,260,752 B2
(45) Date of Patent: Apr. 16, 2019

(54) TRANSITION DUCT ASSEMBLY WITH LATE INJECTION FEATURES

(71) Applicant: General Electric Company, Schenectady, NY (US)

(72) Inventors: Jeffrey Scott LeBegue, Greer, SC (US); Kevin Weston McMahan, Greer, SC (US); James Scott Flanagan, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 400 days.

(21) Appl. No.: 15/079,091

(22) Filed: Mar. 24, 2016

(65) Prior Publication Data

US 2017/0276368 A1 Sep. 28, 2017

(51) Int. Cl.

| | |
|---|---|
| ***F23R 3/34*** | (2006.01) |
| ***F23R 3/42*** | (2006.01) |
| ***F23R 3/46*** | (2006.01) |

(52) U.S. Cl.

CPC ..... *F23R 3/346* (2013.01); *F23R 3/425* (2013.01); *F23R 3/46* (2013.01); *F23R 2900/03041* (2013.01); *F23R 2900/03044* (2013.01)

(58) Field of Classification Search

CPC .... F23R 3/28; F23R 3/286; F23R 3/34; F23R 3/346; F23R 3/46; F02C 7/222

See application file for complete search history.

(56) References Cited

U.S. PATENT DOCUMENTS

| | | | |
|---|---|---|---|
| 4,422,288 | A | 12/1983 | Steber |
| 5,077,967 | A | 1/1992 | Widener et al. |
| 5,118,120 | A | 6/1992 | Drerup et al. |
| 5,249,920 | A | 10/1993 | Shepherd et al. |
| 5,414,999 | A | 5/1995 | Barnes |

(Continued)

FOREIGN PATENT DOCUMENTS

| | | | |
|---|---|---|---|
| EP | 1722069 | A1 | 11/2006 |

OTHER PUBLICATIONS

Extended European Search Report and Opinion issued in connection with corresponding EP Application No. 17161635.2 dated Oct. 19, 2017.

(Continued)

*Primary Examiner* — Arun Goyal

(74) *Attorney, Agent, or Firm* — Charlotte C. Wilson; Ernest G. Cusick; Frank A. Landgraff

(57) ABSTRACT

A turbomachine includes a plurality of transition ducts disposed in a generally annular array. Each of the plurality of transition ducts includes an inlet, an outlet, and a passage defining an interior and extending between the inlet and the outlet and defining a longitudinal axis, a radial axis, and a tangential axis. The outlet of each of the plurality of transition ducts is offset from the inlet along the longitudinal axis and the tangential axis. The turbomachine includes a support ring assembly downstream of the plurality of transition ducts along a hot gas path, and a plurality of mechanical fasteners connecting at least one transition duct of the plurality of transition ducts to the support ring assembly. The turbomachine includes a late injection assembly providing fluid communication for an injection fluid to flow into the interior downstream of the inlet of at least one transition duct of the plurality of transition ducts.

15 Claims, 13 Drawing Sheets

(56) References Cited

U.S. PATENT DOCUMENTS

| | | | | |
|---|---|---|---|---|
| 5,419,250 | A | 5/1995 | Ferguson | |
| 5,457,954 | A | 10/1995 | Boyd et al. | |
| 5,592,820 | A | 1/1997 | Alary et al. | |
| 5,761,898 | A | 6/1998 | Barnes et al. | |
| 5,839,283 | A | 11/1998 | Dübbeling | |
| 5,934,687 | A | 8/1999 | Bagepalli et al. | |
| 6,202,420 | B1 | 3/2001 | Zarzalis et al. | |
| 6,203,025 | B1 | 3/2001 | Hayton | |
| 6,442,946 | B1 | 9/2002 | Kraft et al. | |
| 6,471,475 | B1 | 10/2002 | Sasu et al. | |
| 6,537,023 | B1 | 3/2003 | Aksit et al. | |
| 6,564,555 | B2 | 5/2003 | Rice et al. | |
| 6,640,547 | B2 | 11/2003 | Leahy, Jr. | |
| 6,652,229 | B2 | 11/2003 | Lu | |
| 6,662,567 | B1 | 12/2003 | Jorgensen | |
| 7,007,480 | B2 | 3/2006 | Nguyen et al. | |
| 7,024,863 | B2 | 4/2006 | Morenko | |
| 7,181,914 | B2 | 2/2007 | Pidcock et al. | |
| 7,584,620 | B2 | 9/2009 | Weaver et al. | |
| 7,603,863 | B2 | 10/2009 | Widener et al. | |
| 7,637,110 | B2 | 12/2009 | Czachor et al. | |
| 7,721,547 | B2 | 5/2010 | Bancalari et al. | |
| 7,836,677 | B2 | 11/2010 | Bland | |
| 7,958,734 | B2 | 6/2011 | Paprotna et al. | |
| 8,065,881 | B2 | 11/2011 | Charron et al. | |
| 8,091,365 | B2 | 1/2012 | Charron | |
| 8,113,003 | B2 | 2/2012 | Charron et al. | |
| 8,230,688 | B2 | 7/2012 | Wilson et al. | |
| 8,276,389 | B2 | 10/2012 | Charron et al. | |
| 8,616,007 | B2 | 12/2013 | Charron | |
| 8,667,682 | B2 | 3/2014 | Lee et al. | |
| 8,701,415 | B2 * | 4/2014 | Flanagan | F01D 11/005 277/312 |
| 8,707,673 | B1 | 4/2014 | Flanagan et al. | |
| 8,745,986 | B2 | 6/2014 | Melton et al. | |
| 8,826,668 | B2 | 9/2014 | Lee et al. | |
| 8,915,706 | B2 | 12/2014 | Stein et al. | |
| 8,959,888 | B2 | 2/2015 | Laster et al. | |
| 8,961,118 | B2 | 2/2015 | Charron et al. | |
| 8,978,389 | B2 | 3/2015 | Wiebe | |
| 9,090,954 | B2 | 7/2015 | Tassios et al. | |
| 9,133,722 | B2 * | 9/2015 | LeBegue | F01D 9/023 |
| 9,528,439 | B2 * | 12/2016 | Graham | F01D 9/023 |
| 2009/0145137 | A1 | 6/2009 | Rizkalla et al. | |
| 2010/0037618 | A1 | 2/2010 | Charron et al. | |
| 2010/0037619 | A1 | 2/2010 | Charron | |
| 2010/0054928 | A1 | 3/2010 | Schiavo | |
| 2010/0115953 | A1 | 5/2010 | Davis, Jr. et al. | |
| 2011/0056206 | A1 | 3/2011 | Wiege | |
| 2011/0067402 | A1 | 3/2011 | Wiebe et al. | |
| 2011/0259015 | A1 | 10/2011 | Johns et al. | |
| 2012/0031068 | A1 | 2/2012 | Charron | |
| 2012/0304653 | A1 | 12/2012 | Flanagan et al. | |
| 2012/0304665 | A1 | 12/2012 | LeBegue | |
| 2013/0061570 | A1 | 3/2013 | Charron et al. | |
| 2013/0081399 | A1 | 4/2013 | Wiebe | |
| 2013/0081407 | A1 | 4/2013 | Wiebe | |
| 2013/0139523 | A1 | 6/2013 | Myers et al. | |
| 2013/0174561 | A1 | 7/2013 | Stoia et al. | |
| 2013/0219853 | A1 | 8/2013 | Little et al. | |
| 2013/0219921 | A1 | 8/2013 | Wiebe et al. | |
| 2013/0224007 | A1 | 8/2013 | Rodriguez | |
| 2013/0224009 | A1 | 8/2013 | Little et al. | |
| 2013/0239585 | A1 | 9/2013 | Morrison | |
| 2014/0060000 | A1 | 3/2014 | Charron et al. | |
| 2014/0060001 | A1 | 3/2014 | Beeck | |
| 2014/0260303 | A1 | 9/2014 | Davis, Jr. et al. | |
| 2014/0260317 | A1 | 9/2014 | Charron et al. | |
| 2014/0338304 | A1 | 11/2014 | Schilp | |
| 2014/0352321 | A1 | 12/2014 | Haynes et al. | |
| 2015/0068211 | A1 | 3/2015 | Rodriguez | |
| 2015/0082794 | A1 | 3/2015 | Schilp | |
| 2015/0107264 | A1 | 4/2015 | Wiebe et al. | |
| 2015/0132117 | A1 | 5/2015 | Marra et al. | |
| 2015/0198054 | A1 | 7/2015 | Charron et al. | |
| 2015/0204243 | A1 | 7/2015 | Charron et al. | |
| 2016/0061450 | A1 | 3/2016 | Pankey | |

OTHER PUBLICATIONS

Hughes, et al.; U.S. Appl. No. 14/977,993, filed Dec. 22, 2015.
Hughes, et al.; U.S. Appl. No. 14/978,006, filed Dec. 22, 2015.
Hughes, et al.; U.S. Appl. No. 14/978,019, filed Dec. 22, 2015.

* cited by examiner

— PRIOR ART —

— PRIOR ART —

TRANSITION DUCT ASSEMBLY WITH LATE INJECTION FEATURES

FIELD OF THE DISCLOSURE

The subject matter disclosed herein relates generally to turbomachines, and more particularly to the use of transition ducts with late injection features in turbomachines.

BACKGROUND OF THE DISCLOSURE

Turbomachines are widely utilized in fields such as power generation. For example, a conventional gas turbine system includes a compressor section, a combustor section, and at least one turbine section. The compressor section is configured to compress air as the air flows through the compressor section. The air is then flowed from the compressor section to the combustor section, where it is mixed with fuel and combusted, generating a hot gas flow. The hot gas flow is provided to the turbine section, which utilizes the hot gas flow by extracting energy from it to power the compressor, an electrical generator, and other various loads.

The combustor sections of turbomachines generally include tubes or ducts for flowing the combusted hot gas therethrough to the turbine section or sections. Recently, combustor sections have been introduced which include tubes or ducts that shift the flow of the hot gas. For example, ducts for combustor sections have been introduced that, while flowing the hot gas longitudinally therethrough, additionally shift the flow radially and/or tangentially such that the flow has various angular components. These designs have various advantages, including eliminating first stage nozzles from the turbine sections. The first stage nozzles were previously provided to shift the hot gas flow, and may not be required due to the design of these ducts. The elimination of first stage nozzles may eliminate associated pressure drops and increase the efficiency and power output of the turbomachine.

Various design and operating parameters influence the design and operation of combustor sections. For example, higher combustion gas temperatures generally improve the thermodynamic efficiency of the combustor section. However, higher combustion gas temperatures also promote flashback and/or flame holding conditions in which the combustion flame migrates towards the fuel being supplied by fuel nozzles, possibly causing severe damage to the fuel nozzles in a relatively short amount of time. In addition, higher combustion gas temperatures generally increase the disassociation rate of diatomic nitrogen, increasing the production of nitrogen oxides (NOX). Conversely, a lower combustion gas temperature associated with reduced fuel flow and/or part load operation (turndown) generally reduces the chemical reaction rates of the combustion gases, increasing the production of carbon monoxide and unburned hydrocarbons. These design and operating parameters are of particular concern when utilizing ducts that shift the flow of the hot gas therein, as discussed above.

BRIEF DESCRIPTION OF THE DISCLOSURE

Aspects and advantages of the disclosure will be set forth in part in the following description, or may be obvious from the description, or may be learned through practice of the disclosure.

In one embodiment, a turbomachine is provided. The turbomachine includes a plurality of transition ducts disposed in a generally annular array and including a first transition duct and a second transition duct. Each of the plurality of transition ducts includes an inlet, an outlet, and a passage defining an interior and extending between the inlet and the outlet and defining a longitudinal axis, a radial axis, and a tangential axis. The outlet of each of the plurality of transition ducts is offset from the inlet along the longitudinal axis and the tangential axis. The turbomachine further includes a support ring assembly downstream of the plurality of transition ducts along a hot gas path, and a plurality of mechanical fasteners connecting at least one transition duct of the plurality of transition ducts to the support ring assembly. The turbomachine further includes a late injection assembly providing fluid communication for an injection fluid to flow into the interior downstream of the inlet of at least one transition duct of the plurality of transition ducts.

In another embodiment, a turbomachine is provided. The turbomachine includes a plurality of transition ducts disposed in a generally annular array and including a first transition duct and a second transition duct. Each of the plurality of transition ducts includes an inlet, an outlet, and a passage defining an interior and extending between the inlet and the outlet and defining a longitudinal axis, a radial axis, and a tangential axis. The outlet of each of the plurality of transition ducts is offset from the inlet along the longitudinal axis and the tangential axis. The turbomachine further includes a support ring assembly downstream of the plurality of transition ducts along a hot gas path, and a plurality of mechanical fasteners connecting at least one transition duct of the plurality of transition ducts to the support ring assembly. The turbomachine further includes a late injection assembly providing fluid communication for an injection fluid to flow into the interior of at least one transition duct of the plurality of transition ducts, wherein an outlet of the late injection assembly is defined downstream of a choke plane defined in the interior of the at least one transition duct.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which:

FIG. 13 is a cross-sectional view of outlets of neighboring transition ducts according to embodiments of the present disclosure.

DETAILED DESCRIPTION OF THE DISCLOSURE

Figure 1:
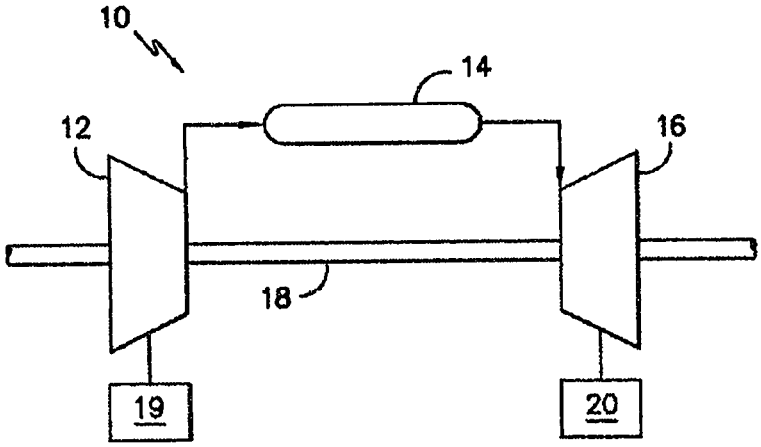
FIG. 1 is a schematic view of a gas turbine system according to embodiments of the present disclosure.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

FIG. 1 is a schematic diagram of a turbomachine, which in the embodiment shown is a gas turbine system 10. It should be understood that the turbomachine of the present disclosure need not be a gas turbine system 10, but rather may be any suitable turbine system or other turbomachine, such as a steam turbine system or other suitable system. The system 10 as shown may include a compressor section 12, a combustor section 14 which may include a plurality of combustors 15 as discussed below, and a turbine section 16. The compressor section 12 and turbine section 16 may be coupled by a shaft 18. The shaft 18 may be a single shaft or a plurality of shaft segments coupled together to form shaft 18. The shaft 18 may further be coupled to a generator or other suitable energy storage device, or may be connected directly to, for example, an electrical grid. An inlet section 19 may provide an air flow to the compressor section 12, and exhaust gases may be exhausted from the turbine section 16 through an exhaust section 20 and exhausted and/or utilized in the system 10 or other suitable system. Exhaust gases from the system 10 may for example be exhausted into the atmosphere, flowed to a steam turbine or other suitable system, or recycled through a heat recovery steam generator.

Figure 2:
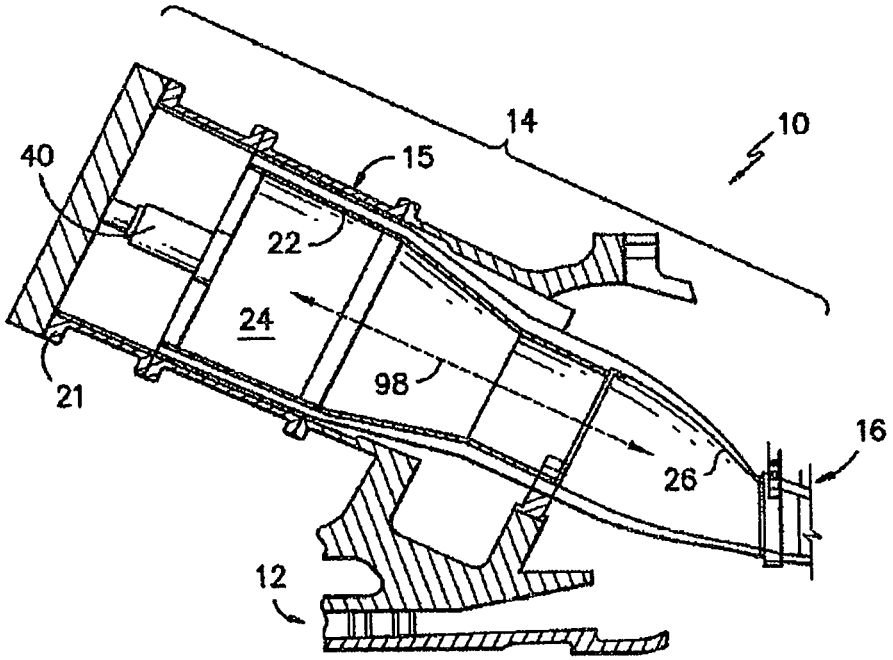
FIG. 2 is a cross-sectional view of several portions of a gas turbine system according to embodiments of the present disclosure.

Referring to FIG. 2, a simplified drawing of several portions of a gas turbine system 10 is illustrated. The gas turbine system 10 as shown in FIG. 2 includes a compressor section 12 for pressurizing a working fluid, discussed below, that is flowing through the system 10. Pressurized working fluid discharged from the compressor section 12 flows into a combustor section 14, which may include a plurality of combustors 15 (only one of which is illustrated in FIG. 2) disposed in an annular array about an axis of the system 10. The working fluid entering the combustor section 14 is mixed with fuel, such as natural gas or another suitable liquid or gas, and combusted. Hot gases of combustion flow from each combustor 15 to a turbine section 16 to drive the system 10 and generate power.

A combustor 15 in the gas turbine 10 may include a variety of components for mixing and combusting the working fluid and fuel. For example, the combustor 15 may include a casing 21, such as a compressor discharge casing 21. A variety of sleeves, which may be axially extending annular sleeves, may be at least partially disposed in the casing 21. The sleeves, as shown in FIG. 2, extend axially along a generally longitudinal axis 98, such that the inlet of a sleeve is axially aligned with the outlet. For example, a combustor liner 22 may generally define a combustion zone 24 therein. Combustion of the working fluid, fuel, and optional oxidizer may generally occur in the combustion zone 24. The resulting hot gases of combustion may flow generally axially along the longitudinal axis 98 downstream through the combustion liner 22 into a transition piece 26, and then flow generally axially along the longitudinal axis 98 through the transition piece 26 and into the turbine section 16.

The combustor 15 may further include a fuel nozzle 40 or a plurality of fuel nozzles 40. Fuel may be supplied to the fuel nozzles 40 by one or more manifolds (not shown). As discussed below, the fuel nozzle 40 or fuel nozzles 40 may supply the fuel and, optionally, working fluid to the combustion zone 24 for combustion.

Referring now to FIGS. 4 through 15, a combustor 15 according to the present disclosure may include a transition duct 50, generally referred to as a transition duct assembly. The transition ducts 50 of the present disclosure may be provided in place of various axially extending sleeves of other combustors. For example, a transition duct 50 may replace the axially extending transition piece 26 and, optionally, the combustor liner 22 of a combustor 15. Thus, the transition duct may extend from the fuel nozzles 40, or from the combustor liner 22. As discussed herein, the transition duct 50 may provide various advantages over the axially extending combustor liners 22 and transition pieces 26 for flowing working fluid therethrough and to the turbine section 16.

As shown, the plurality of transition ducts 50 may be disposed in an annular array about a longitudinal axis 90. Further, each transition duct 50 may extend between a fuel nozzle 40 or plurality of fuel nozzles 40 and the turbine section 16. For example, each transition duct 50 may extend from the fuel nozzles 40 to the turbine section 16. Thus, working fluid may flow generally from the fuel nozzles 40 through the transition duct 50 to the turbine section 16. In some embodiments, the transition ducts 50 may advantageously allow for the elimination of the first stage nozzles in the turbine section, which may eliminate any associated drag and pressure drop and increase the efficiency and output of the system 10.

Each transition duct 50 may have an inlet 52, an outlet 54, and a passage 56 therebetween which may define an interior 57. The inlet 52 and outlet 54 of a transition duct 50 may have generally circular or oval cross-sections, rectangular cross-sections, triangular cross-sections, or any other suitable polygonal cross-sections. Further, it should be understood that the inlet 52 and outlet 54 of a transition duct 50 need not have similarly shaped cross-sections. For example, in one embodiment, the inlet 52 may have a generally circular cross-section, while the outlet 54 may have a generally rectangular cross-section.

Further, the passage 56 may be generally tapered between the inlet 52 and the outlet 54. For example, in an exemplary embodiment, at least a portion of the passage 56 may be generally conically shaped. Additionally or alternatively, however, the passage 56 or any portion thereof may have a generally rectangular cross-section, triangular cross-section, or any other suitable polygonal cross-section. It should be understood that the cross-sectional shape of the passage 56 may change throughout the passage 56 or any portion thereof as the passage 56 tapers from the relatively larger inlet 52 to the relatively smaller outlet 54.

The outlet 54 of each of the plurality of transition ducts 50 may be offset from the inlet 52 of the respective transition duct 50. The term "offset", as used herein, means spaced from along the identified coordinate direction. The outlet 54 of each of the plurality of transition ducts 50 may be longitudinally offset from the inlet 52 of the respective transition duct 50, such as offset along the longitudinal axis 90.

Additionally, in exemplary embodiments, the outlet 54 of each of the plurality of transition ducts 50 may be tangentially offset from the inlet 52 of the respective transition duct 50, such as offset along a tangential axis 92. Because the outlet 54 of each of the plurality of transition ducts 50 is tangentially offset from the inlet 52 of the respective transition duct 50, the transition ducts 50 may advantageously utilize the tangential component of the flow of working fluid through the transition ducts 50 to eliminate the need for first stage nozzles in the turbine section 16, as discussed below.

Further, in exemplary embodiments, the outlet 54 of each of the plurality of transition ducts 50 may be radially offset from the inlet 52 of the respective transition duct 50, such as offset along a radial axis 94. Because the outlet 54 of each of the plurality of transition ducts 50 is radially offset from the inlet 52 of the respective transition duct 50, the transition ducts 50 may advantageously utilize the radial component of the flow of working fluid through the transition ducts 50 to further eliminate the need for first stage nozzles in the turbine section 16, as discussed below.

Figure 4:
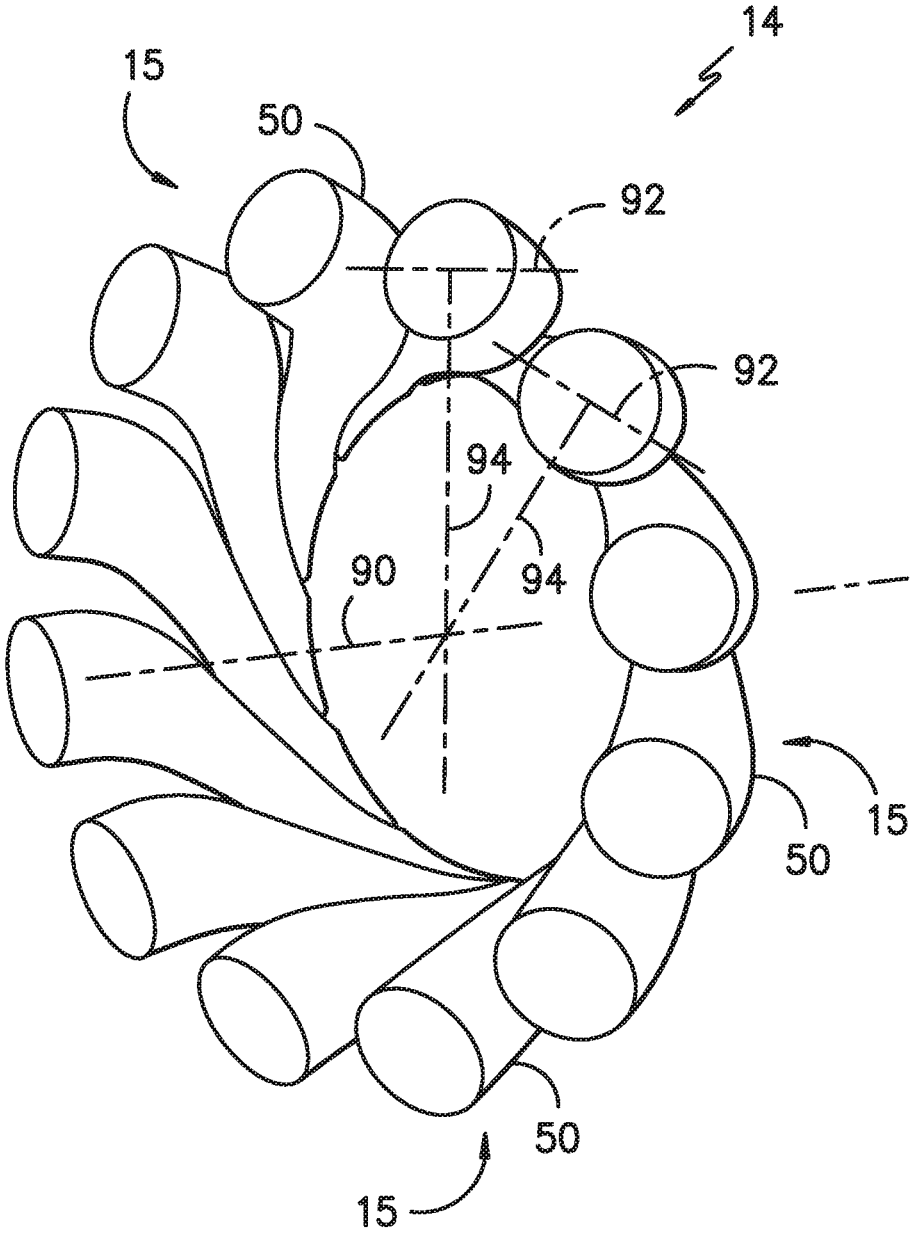
FIG. 4 is a perspective view of an annular array of transition ducts according to embodiments of the present disclosure.

It should be understood that the tangential axis 92 and the radial axis 94 are defined individually for each transition duct 50 with respect to the circumference defined by the annular array of transition ducts 50, as shown in FIG. 4, and that the axes 92 and 94 vary for each transition duct 50 about the circumference based on the number of transition ducts 50 disposed in an annular array about the longitudinal axis 90.

Figure 3:
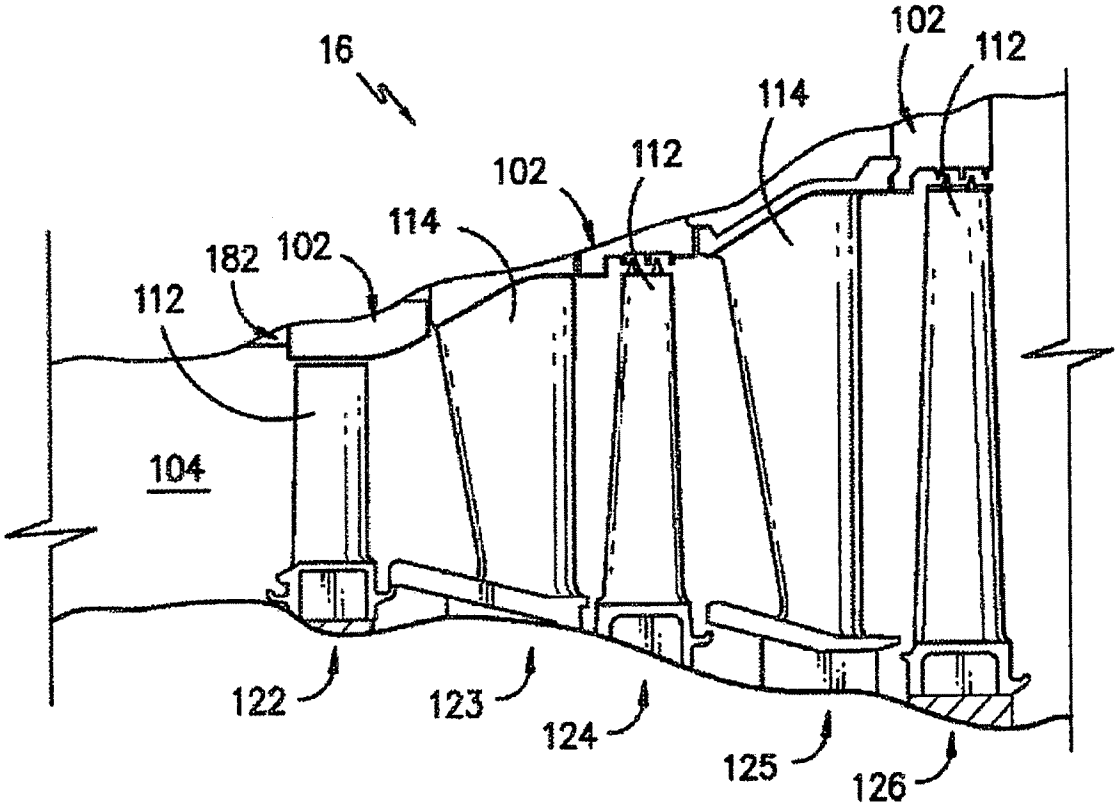
FIG. 3 is a cross-sectional view of a turbine section of a gas turbine system according to embodiments of the present disclosure.

As discussed, after hot gases of combustion are flowed through the transition duct 50, they may be flowed from the transition duct 50 into the turbine section 16. As shown in FIG. 3, a turbine section 16 according to the present disclosure may include a shroud 102, which may define a hot gas path 104. The shroud 102 may be formed from a plurality of shroud blocks. The shroud blocks may be disposed in one or more annular arrays, each of which may define a portion of the hot gas path 104 therein. Turbine section 16 may additionally include a support ring assembly, which may include a lower support ring 180 and an upper support ring 182 and which may for example be positioned upstream (along the hot gas path 104) of the shroud 102 (such as the first plurality of shroud blocks thereof) or may be a first portion of the shroud 102. The support ring assembly may further define the hot gas path 104 (i.e. between the lower and upper support rings 180, 182), and provides the transition between the transition ducts 50 and the turbine section 16. Accordingly, the support ring assembly (and support rings 180, 182 thereof) may be downstream (along the hot gas path 104) of the plurality of transition ducts 50. Hot gas may flow from the transition ducts 50 into and through the support ring assembly (between the support rings 180, 182), and from the support ring assembly through the remainder of the turbine section 16. It should be noted that the support rings may be conventionally referred to nozzle support rings or first stage nozzle support rings. However, as discussed herein, no first stage nozzles may be utilized with transition ducts 50 in accordance with exemplary embodiments of the present disclosure, and thus the support rings in exemplary embodiments do not surround any first stage or other nozzles.

The turbine section 16 may further include a plurality of buckets 112 and a plurality of nozzles 114. Each of the plurality of buckets 112 and nozzles 114 may be at least partially disposed in the hot gas path 104. Further, the plurality of buckets 112 and the plurality of nozzles 114 may be disposed in one or more annular arrays, each of which may define a portion of the hot gas path 104.

The turbine section 16 may include a plurality of turbine stages. Each stage may include a plurality of buckets 112 disposed in an annular array and a plurality of nozzles 114 disposed in an annular array. For example, in one embodiment, the turbine section 16 may have three stages, as shown in FIG. 3. For example, a first stage of the turbine section 16 may include a first stage nozzle assembly (not shown) and a first stage buckets assembly 122. The nozzles assembly may include a plurality of nozzles 114 disposed and fixed circumferentially about the shaft 18. The bucket assembly 122 may include a plurality of buckets 112 disposed circumferentially about the shaft 18 and coupled to the shaft 18. In exemplary embodiments wherein the turbine section is coupled to combustor section 14 including a plurality of transition ducts 50, however, the first stage nozzle assembly may be eliminated, such that no nozzles are disposed upstream of the first stage bucket assembly 122. Upstream may be defined relative to the flow of hot gases of combustion through the hot gas path 104.

A second stage of the turbine section 16 may include a second stage nozzle assembly 123 and a second stage buckets assembly 124. The nozzles 114 included in the nozzle assembly 123 may be disposed and fixed circumferentially about the shaft 18. The buckets 112 included in the bucket assembly 124 may be disposed circumferentially about the shaft 18 and coupled to the shaft 18. The second stage nozzle assembly 123 is thus positioned between the first stage bucket assembly 122 and second stage bucket assembly 124 along the hot gas path 104. A third stage of the turbine section 16 may include a third stage nozzle assembly 125 and a third stage bucket assembly 126. The nozzles 114 included in the nozzle assembly 125 may be disposed and fixed circumferentially about the shaft 18. The buckets 112 included in the bucket assembly 126 may be disposed circumferentially about the shaft 18 and coupled to the shaft 18. The third stage nozzle assembly 125 is thus positioned between the second stage bucket assembly 124 and third stage bucket assembly 126 along the hot gas path 104.

It should be understood that the turbine section 16 is not limited to three stages, but rather that any number of stages are within the scope and spirit of the present disclosure.

Each transition duct 50 may interface with one or more adjacent transition ducts 50. For example, FIGS. 5 through 15 illustrate embodiments of a first transition duct 130 and a second transition duct 132 of the plurality of transition ducts 50. These neighboring transition ducts 130, 132 may include contact faces 134, which may be outer surfaces included in the outlets of the transition duct 50. The contact faces 134 may contact associated contact faces 134 of adjacent neighboring transition ducts 50 and/or the support ring assembly (and support rings 180, 182 thereof), as shown, to provide an interface between the transition ducts 50 and/or between the transition ducts 50 and the support ring assembly. For example, contact faces 134 of the first and second transition ducts 130, 132 may, as shown, contact each other and provide an interface between the first and second transition ducts 130, 132. Further, contact faces 134 of the first and second transition ducts 130, 132 may, as shown, contact the support ring assembly and provide an interface between the transition ducts 130, 132 and the support ring assembly. As discussed herein, seals may be provided between the various contact faces to facilitate sealing at such interfaces. Notably, contact as discussed herein may include direct contact between the components themselves or indirect component through seals disposed between the components.

Figure 7:
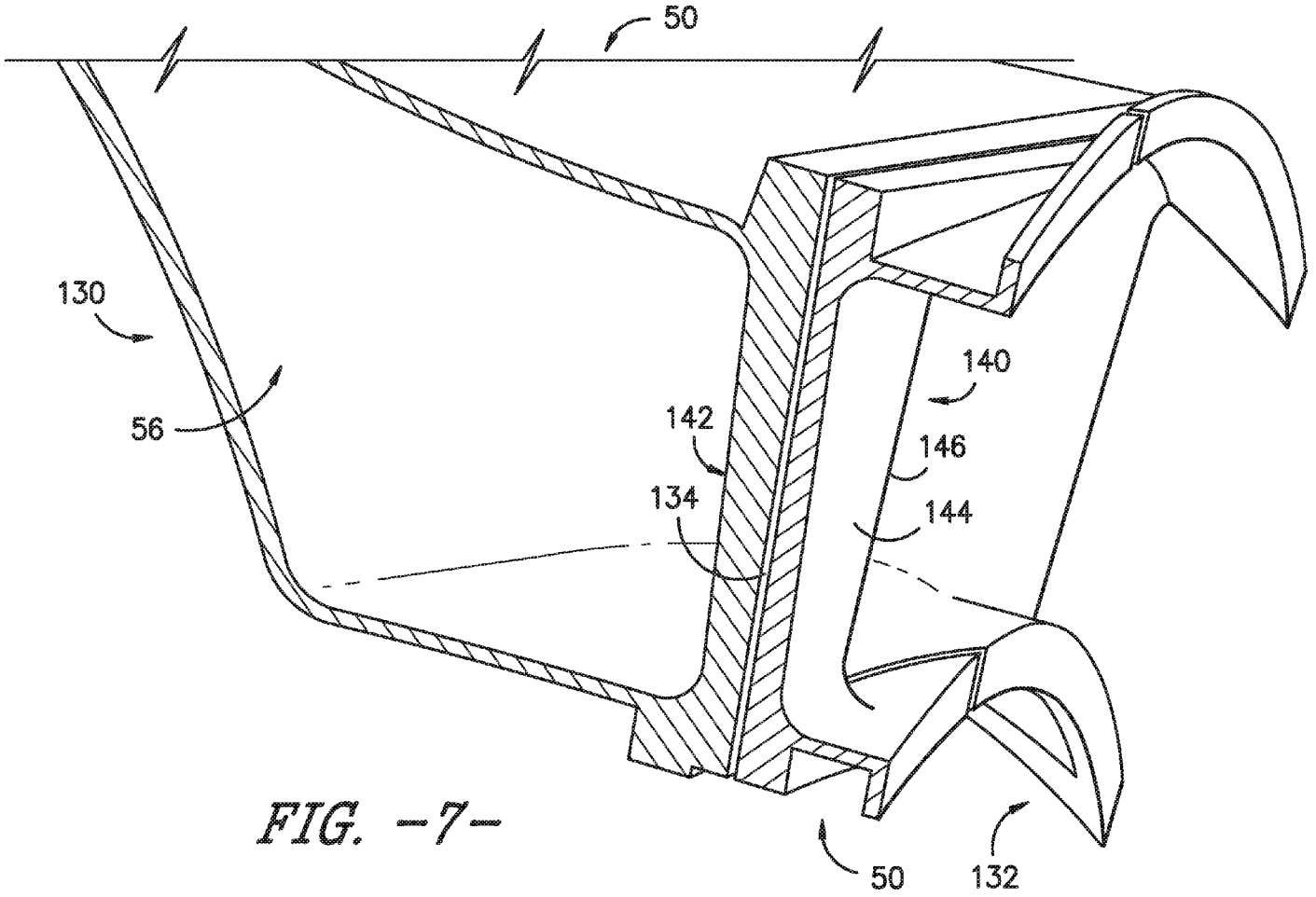
FIG. 7 is a cutaway perspective view of a transition duct assembly, including neighboring transition ducts and forming various portions of an airfoil therebetween according to embodiments of the present disclosure.
Figure 8:
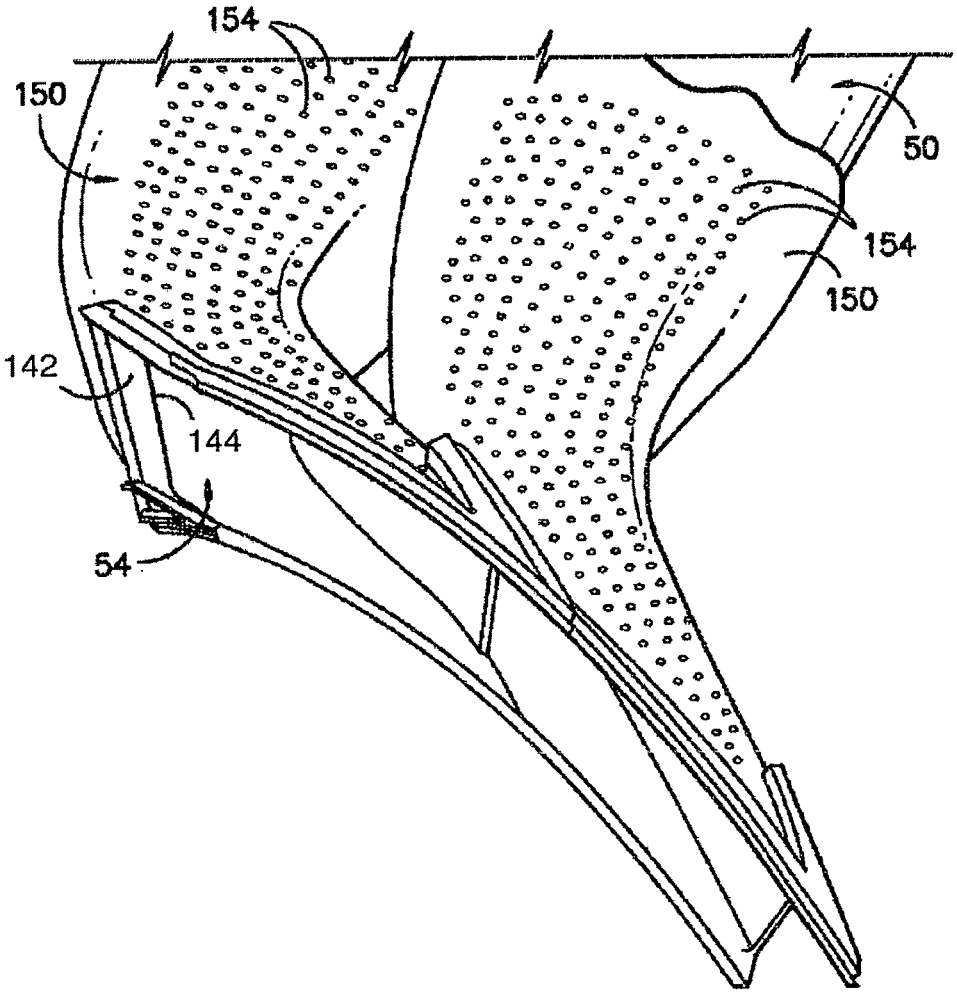
FIG. 8 is a top front perspective view of a plurality of transition ducts and associated impingement sleeves according to embodiments of the present disclosure.
Figure 11:
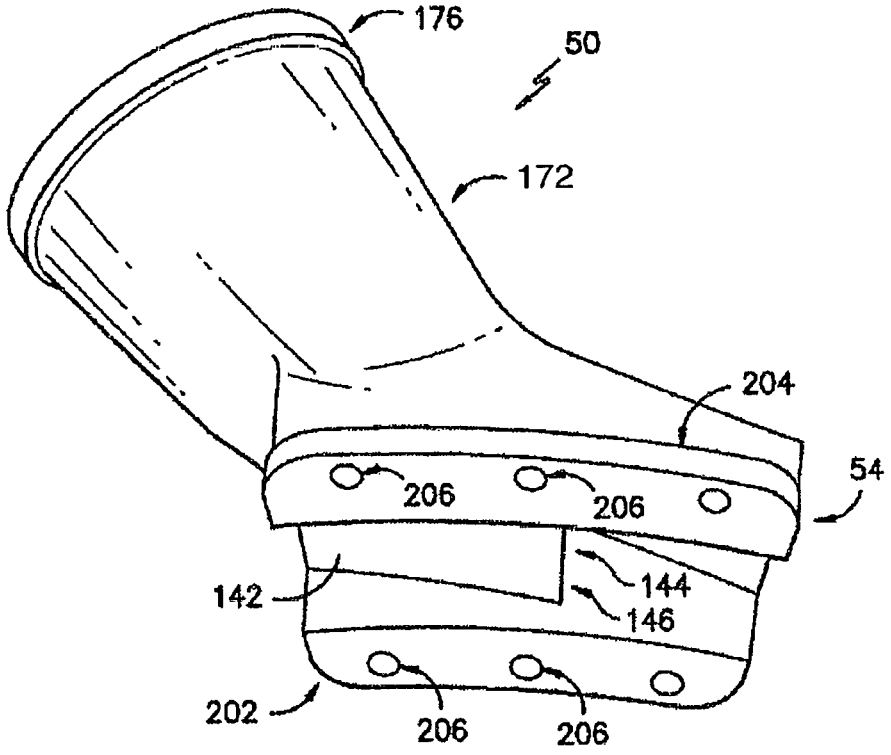
FIG. 11 is a front perspective view of a downstream portion of a transition duct according to embodiments of the present disclosure.

Further, the transition ducts 50, such as the first and second transition ducts 130, 132, may form aerodynamic structures 140 having various aerodynamic surface of an airfoil. Such aerodynamic structure 140 may, for example, be defined by inner surfaces of the passages 56 of the transition ducts 50, and further may be formed when contact faces 134 of adjacent transition ducts 50 interface with each other. These various surfaces may shift the hot gas flow in the transition ducts 50, and thus eliminate the need for first stage nozzles, as discussed herein. For example, in some embodiments as illustrated in FIGS. 7 and 8, an inner surface of a passage 56 of a transition duct 50, such as a first transition duct 130, may define a pressure side 142, while an opposing inner surface of a passage 56 of an adjacent transition duct 50, such as a second transition duct 132, may define a suction side 144. When the adjacent transition ducts 50, such as the contact faces 134 thereof, interface with each other, the pressure side 142 and suction side 144 may combine to define a trailing edge 146. In other embodiments, as illustrated in FIG. 11, inner surfaces of a passage 56 of a transition duct 50, such as a first transition duct 130, may define a pressure side 142 and a suction side 144 as well as a trailing edge therebetween. Inner surfaces of a passage 56 of a neighboring transition duct 50, such as a second transition duct 132, may further define the pressure side 142 and/or the suction side 144.

Figure 5:
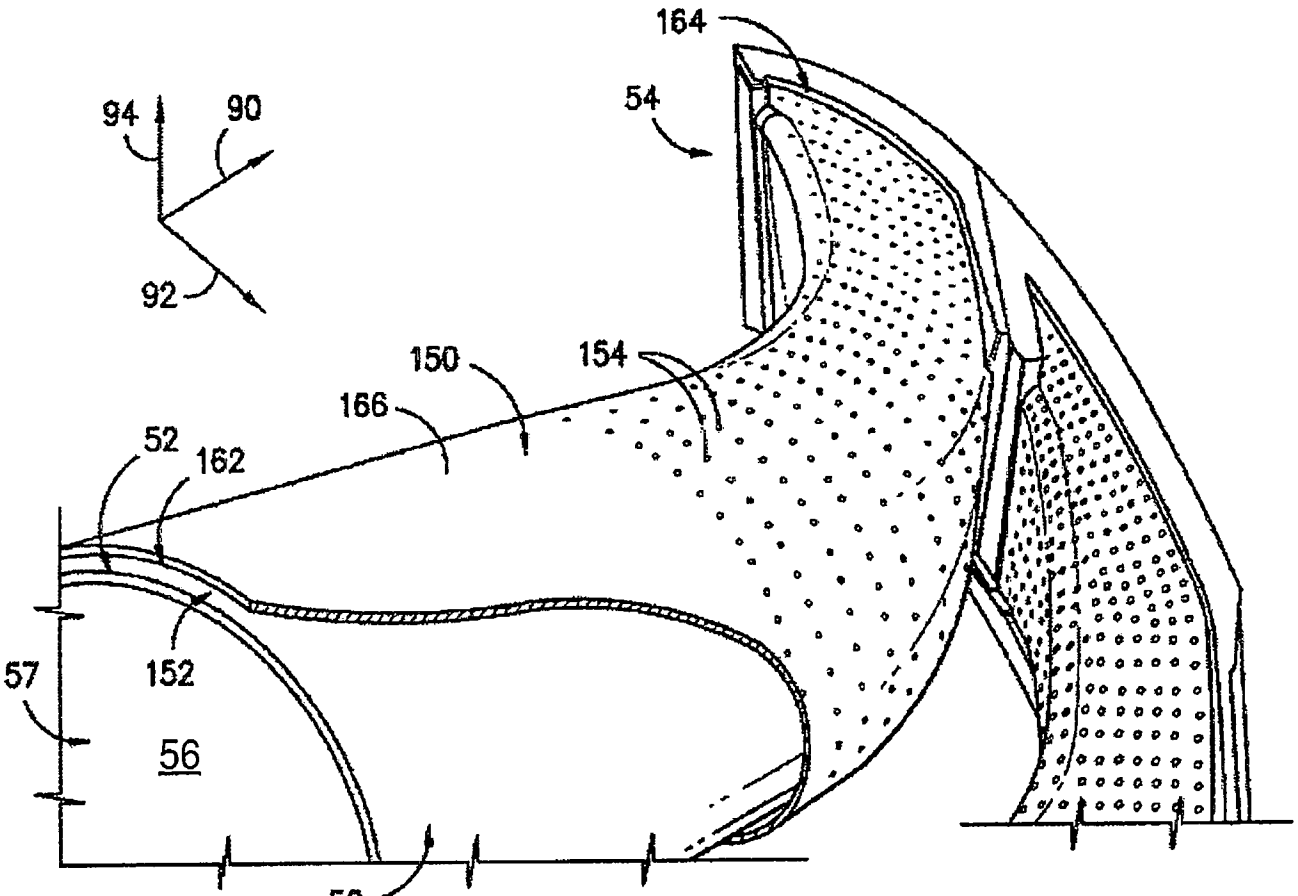
FIG. 5 is a top perspective view of a plurality of transition ducts and associated impingement sleeves according to embodiments of the present disclosure.
Figure 6:
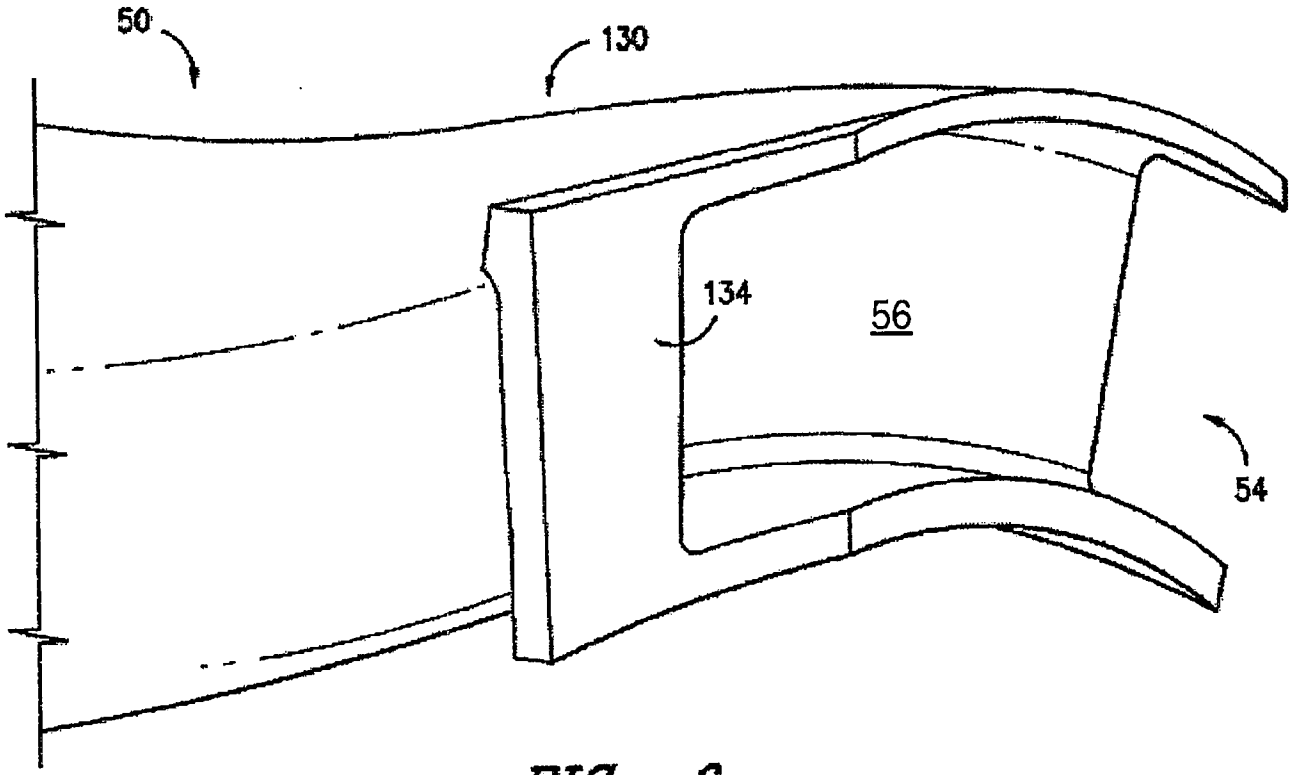
FIG. 6 is a side perspective view of a transition duct according to embodiments of the present disclosure.

As shown in FIGS. 5 and 8, in exemplary embodiments, flow sleeves 150 may circumferentially surround at least a portion of the transition ducts 50. A flow sleeve 150 circumferentially surrounding a transition duct 50 may define an annular passage 152 therebetween. Compressed working fluid from the casing 21 may flow through the annular passage 152 to provide convective cooling transition duct 50 before reversing direction to flow through the fuel nozzles 40 and into the transition duct 50. Further, in some embodiments, the flow sleeve 150 may be an impingement sleeve. In these embodiments, impingement holes 154 may be defined in the sleeve 150, as shown. Compressed working fluid from the casing 21 may flow through the impingement holes 154 and impinge on the transition duct 50 before flowing through the annular passage 152, thus providing additional impingement cooling of the transition duct.

Each flow sleeve 150 may have an inlet 162, an outlet 164, and a passage 166 therebetween. Each flow sleeve 150 may extend between a fuel nozzle 40 or plurality of fuel nozzles 40 and the turbine section 16, thus surrounding at least a portion of the associated transition duct 50. Thus, similar to the transition ducts 50, as discussed above, the outlet 164 of each of the plurality of flow sleeves 150 may be longitudinally, radially, and/or tangentially offset from the inlet 162 of the respective flow sleeve 150.

In some embodiments, as illustrated in FIGS. 5 and 8, a transition duct 50 according to the present disclosure is a single, unitary component extending between the inlet 52 and the outlet 54. In other embodiments, as illustrated in FIGS. 9 through 15, a transition duct 50 according to the present disclosure may include a plurality of sections or portions, which are articulated with respect to each other. This articulation of the transition duct 50 may allow the various portions of the transition duct 50 to move and shift relative to each other during operation, allowing for and accommodating thermal growth thereof. For example, a transition duct 50 may include an upstream portion 170 and a downstream portion 172. The upstream portion 170 may include the inlet 52 of the transition duct 50 and may extend generally downstream therefrom towards the outlet 54. The downstream portion 172 may include the outlet 54 of the transition duct 50 and may extend generally upstream therefrom towards the inlet 52. The upstream portion 170 may thus include and extend between the inlet 52 and an aft end 174, and the downstream portion 172 may include and extend between a head end 176 and the outlet 54.

A joint may couple the upstream portion 170 and downstream portion 172 together and may provide the articulation between the upstream portion 170 and downstream portion 172 that allows the transition duct 50 to move during operation of the turbomachine. Specifically, the joint may couple the aft end 174 and the head end 176 together. The joint may be configured to allow movement of the upstream portion 170 and/or the downstream portion 172 relative to one another about or along at least one axis. Further, in some embodiments, the joint may be configured to allow such movement about or along at least two axes, such as about or along three axes. The axis or axes can be any one or more of the longitudinal axis 90, the tangential axis 92, and/or the radial axis 94. Movement about one of these axes may thus mean that one of the upstream portion 170 and/or the downstream portion 172 (or both) can rotate or otherwise move about the axis with respect to the other due to the joint providing this degree of freedom between the upstream portion 170 and downstream portion 172. Movement along one of these axes may thus mean that one of the upstream portion 170 or the downstream portion 172 (or both) can translate or otherwise move along the axis with respect to the other due to the joint providing this degree of freedom between the upstream portion 170 and downstream portion 172. In exemplary embodiments the joint may be a hula seal. Alternatively, other suitable seals or other joints may be utilized.

In some embodiments, use of an upstream portion 170 and downstream portion 172 can advantageously allow specific materials to be utilized for these portions. For example, the downstream portions 172 can advantageously be formed from ceramic materials, such as ceramic matrix composites. The upstream portions 170 and flow sleeves 150 can be formed from suitable metals. Use of ceramic materials is particularly advantageous due to their relatively higher temperature tolerances. Ceramic material can in particular be advantageously utilized for downstream portions 172 when the downstream portions 172 are connected to the support ring assembly (as discussed herein) and the upstream portions 170 can move relative to the downstream portions 172, as movement of the downstream portions 172 is minimized, thus lessening concerns about using relatively brittle ceramic materials.

In some embodiments, the interface between the transition ducts 50, such as the outlets 54 thereof, and the support ring assembly (and support rings 180, 182 thereof) may be a floating interface. For example, the outlets 54 may not be connected to the support rings 180, 182 and may be allowed to move relative to the support rings 180, 182. This may allow for thermal growth of the transition ducts 50 during operation. Suitable floating seals, which can accommodate such movement, may be disposed between the outlets 54 and the support rings 180, 182. Alternatively, and referring now to FIGS. 9 through 15, in some embodiments, the interface between the transition ducts 50, such as the outlets 54 thereof, and the support rings 180, 182 may be a connected interface. In exemplary embodiments, for example, connected interfaces may be utilized with articulated transition ducts that include upstream and downstream portions 170, 172.

For example, as illustrated, a plurality of mechanical fasteners 200 may be provided. The mechanical fasteners 200 may connect one or more of the transition ducts 50 (such as the outlets 54 thereof), including for example the first and/or second transition ducts 130, 132, to contact surfaces 186 of the support ring assembly (and support rings 180, 182 thereof). In exemplary embodiments as illustrated, a mechanical fastener 200 in accordance with the present disclosure includes a bolt and may for example be a nut/bolt combination. In alternative embodiments, a mechanical fastener in accordance with the present disclosure may be or include a pin, screw, nail, rivet, etc.

As illustrated mechanical fasteners 200 may extend through portions of the transition ducts 50 (such as the outlets 54 thereof) and support ring assembly (and support rings 180, 182 thereof) to connect these components together. The outlet 54 of a transition duct 50 may, for example, include an inner flange 202 and/or outer flange 204 (which may be/define contact faces 134 of the transition duct 50). The inner flange 202 may be disposed radially inward of the outer flange 204, and an opening of the outlet 54 through which hot gas flows from the transition duct 50 into and through the support ring assembly (between the support rings 180, 182) may be defined between the inner flange 202 and the outer flange 204. Bore holes 203, 205 may be defined in the inner 202 and outer flanges 204, respectively. The bore holes 203, 205 may align with mating bore holes (not shown) defined in the support rings 180, 182, and mechanical fasteners 200 may extend through each bore hole 203, 205 and mating bore hole to connect the flange 202, 204 and support rings 180, 182 together.

Referring now to FIGS. 9 and 12 through 15, one or more late injection assemblies 210 may be provided. Late injection of injection fluid into the interior 57 may be provided through the late injection assemblies 210. In particular, each late injection assembly 210 may be in fluid communication with the interior 57 of one or more transition ducts 50 and may thus provide fluid communication for the injection fluid to flow into the interior 57 downstream of the inlet(s) 52 of ono or more transition ducts 50.

The injection fluid may include fuel and, optionally, working fluid. In some embodiments, the injection fluid may be a lean mixture of fuel and working fluid, and may thus be provided as a late lean injection. In other embodiments, the injection fluid may be only fuel, without any working fluid, or may be another suitable mixture of fuel and working fluid.

A late injection assembly 210 in accordance with the present disclosure may include an inlet tube 212. An inlet 214 of the inlet tube 212 may be in fluid communication with the casing 21. Thus, a portion of the compressed working fluid exiting the compressor section 12 may flow from inside the casing 21 into the inlet tube 212 through the inlet 214, and through the tube 212 to mix with fuel to produce an injection fluid.

In exemplary embodiments, one or more fuel ports 216 may be defined in an inlet tube 212. The fuel ports 216 may, for example, be circumferentially arranged about a tube 212 as shown. Each fuel port 216 may provide fluid communication for a fuel to flow into the tube 212 through the fuel port 216. In embodiments wherein the tube 212 includes an inlet 214 allowing working fluid therein, the fuel and working fluid may mix within the tube 212 to produce the injection fluid. In other embodiments, a tube 212 may not include an inlet 214, and no working fluid may be flowed into the tube 212. In these embodiments, the injection fluid may include fuel, without such compressed working fluid included therein.

As shown, one or more fuel conduits 218 may be provided in fluid communication with each tube 212. For example, each fuel conduit 218 may be in fluid communication with the tube 212 through a fuel port 216. Fuel may be supplied from a fuel source 220 through a fuel conduit 218, and from a fuel conduit 218 through a fuel port 216 into the tube 212.

The injection fluid produced in each tube 160 may be flowed, or injected, from an inlet tube 212 into the interior 57 of one or more transition ducts 50. By injecting the injection fluid downstream of the fuel nozzles 40 and inlets 52 of the transition ducts 50, and thus downstream of the location of initial combustion, such injection results in additional combustion that raises the combustion gas temperature and increases the thermodynamic efficiency of the combustor 15. The use of late injection assemblies 210 is thus effective at increasing combustion gas temperatures without producing a corresponding increase in the production of $NO_X$. Further, the use of such late injection assemblies 210 is particularly advantageous in combustors 15 that utilize transition ducts 50.

Figure 15:
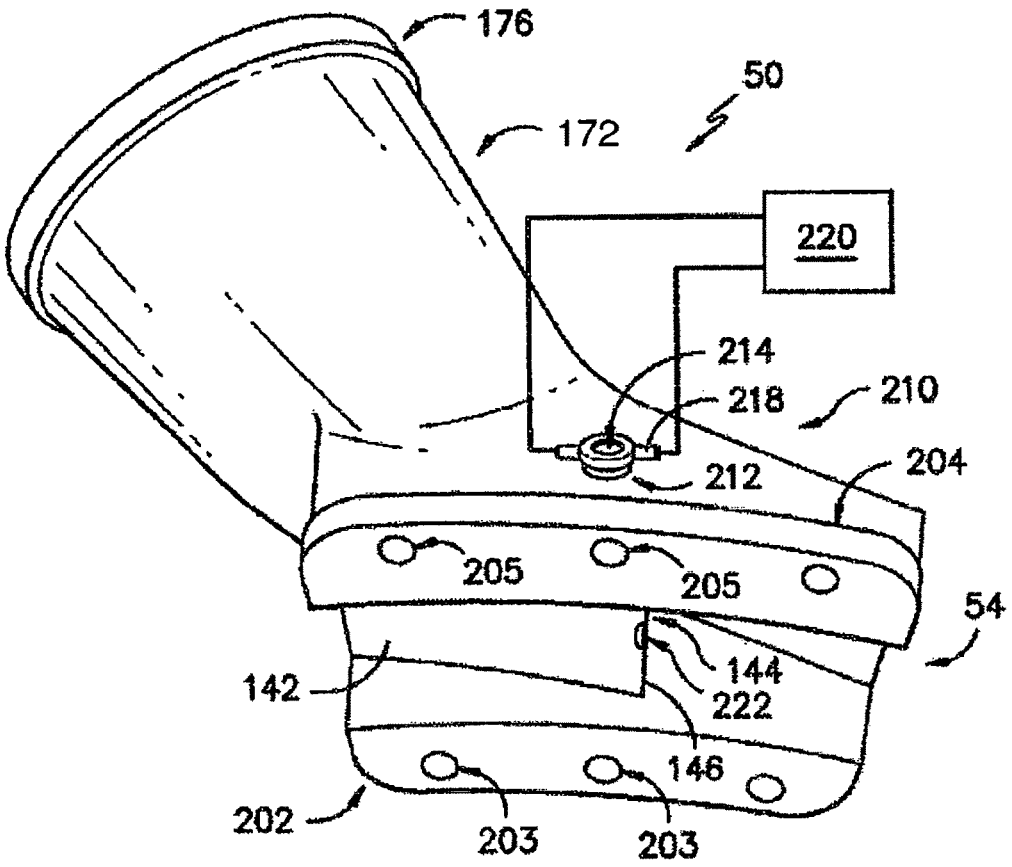
FIG. 15 is a front perspective view of a downstream portion of a transition duct according to embodiments of the present disclosure.

Injection fluid may be exhausted from late injection assemblies 210 through one or more outlets 222. An outlet 222 may exhaust the injection fluid at any suitable location along the transition duct 50 that is downstream of the inlet 52. For example, an outlet 222 may exhaust injection fluid into a forward portion of the transition duct 50. The forward portion may be, for example, a forward 50% or 25% of a length of the transition duct 50, as measured from the inlet 52 of the transition duct and generally along the longitudinal axis 90. Alternatively, an outlet 222 may exhaust injection fluid into an aft portion of the transition duct 50. The aft portion may be, for example, an aft 50% or 25% of a length of the transition duct 50, as measured from the outlet 54 of the transition duct and generally along the longitudinal axis 90. In exemplary embodiments, an outlet 222 may be defined (such as in passage 56) downstream of a choke plane defined in an interior 57 of a passage 56 (and thus between the choke plane and the outlet 54). A choke plane, as generally understood, is a location wherein a cross-sectional area of the interior 57 between interior surfaces of the passage 50 is at a minimum. For example, in some embodiments, a choke plane may be defined at or proximate a trailing edge 146 within an interior 57. Further, in some exemplary embodiments, as shown in FIGS. 11 and 15, an outlet 222 may be defined in a trailing edge 146 formed by the inner surfaces of one or more transition ducts 50. In other embodiments, an outlet 222 may be defined in a pressure side 142 or a suction side 144.

Figure 9:
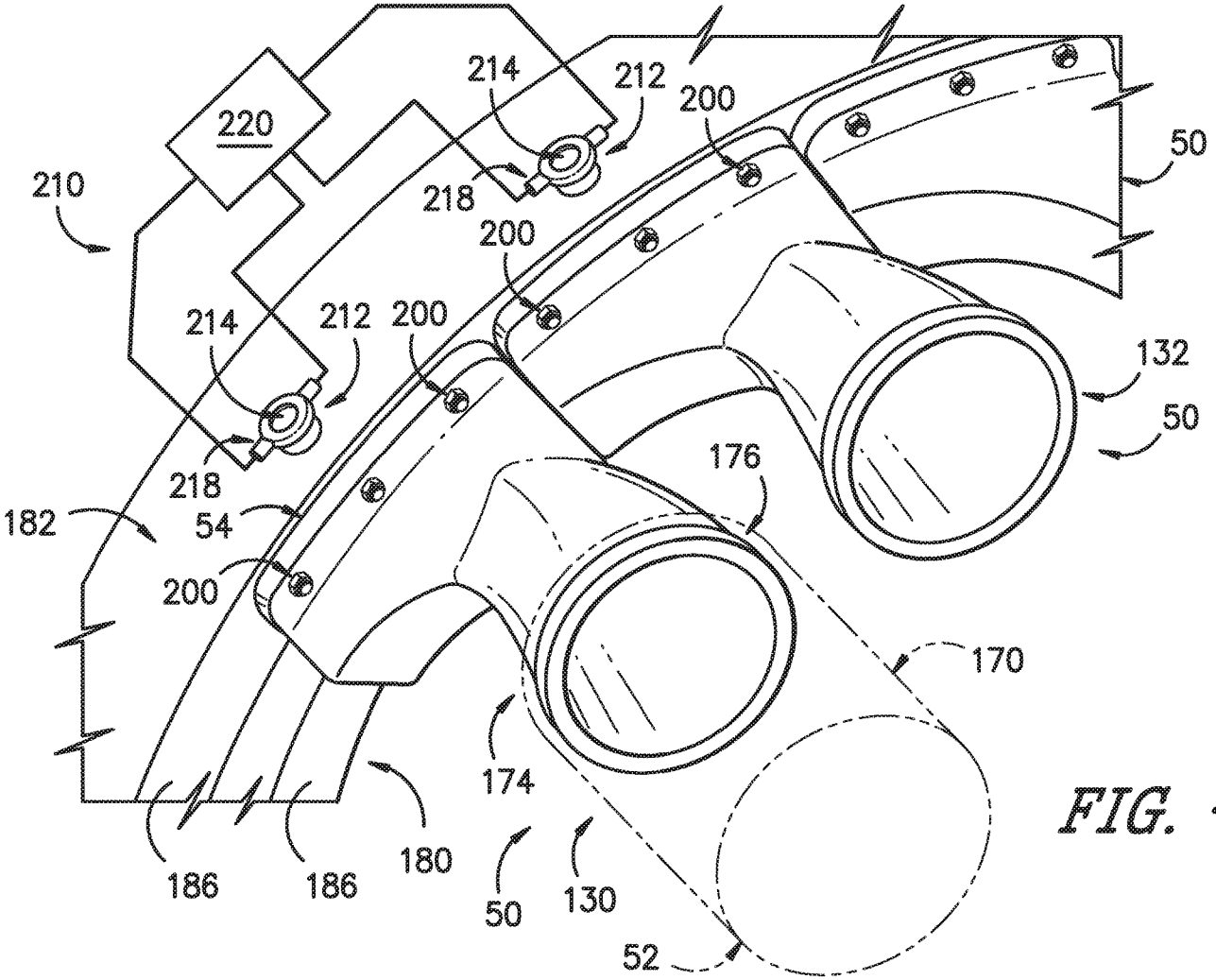
FIG. 9 is a top rear perspective view of a plurality of transition ducts connected to a support ring assembly according to embodiments of the present disclosure.
Figure 10:
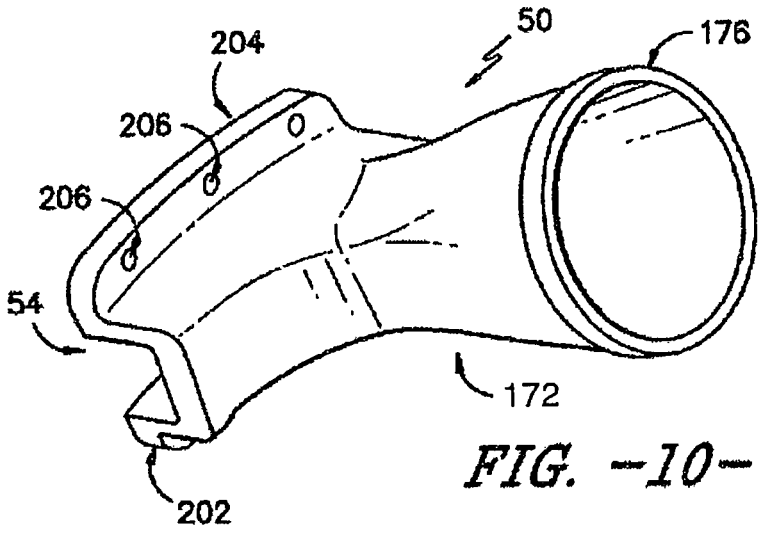
FIG. 10 is a side perspective view of a downstream portion of a transition duct according to embodiments of the present disclosure.
Figure 12:
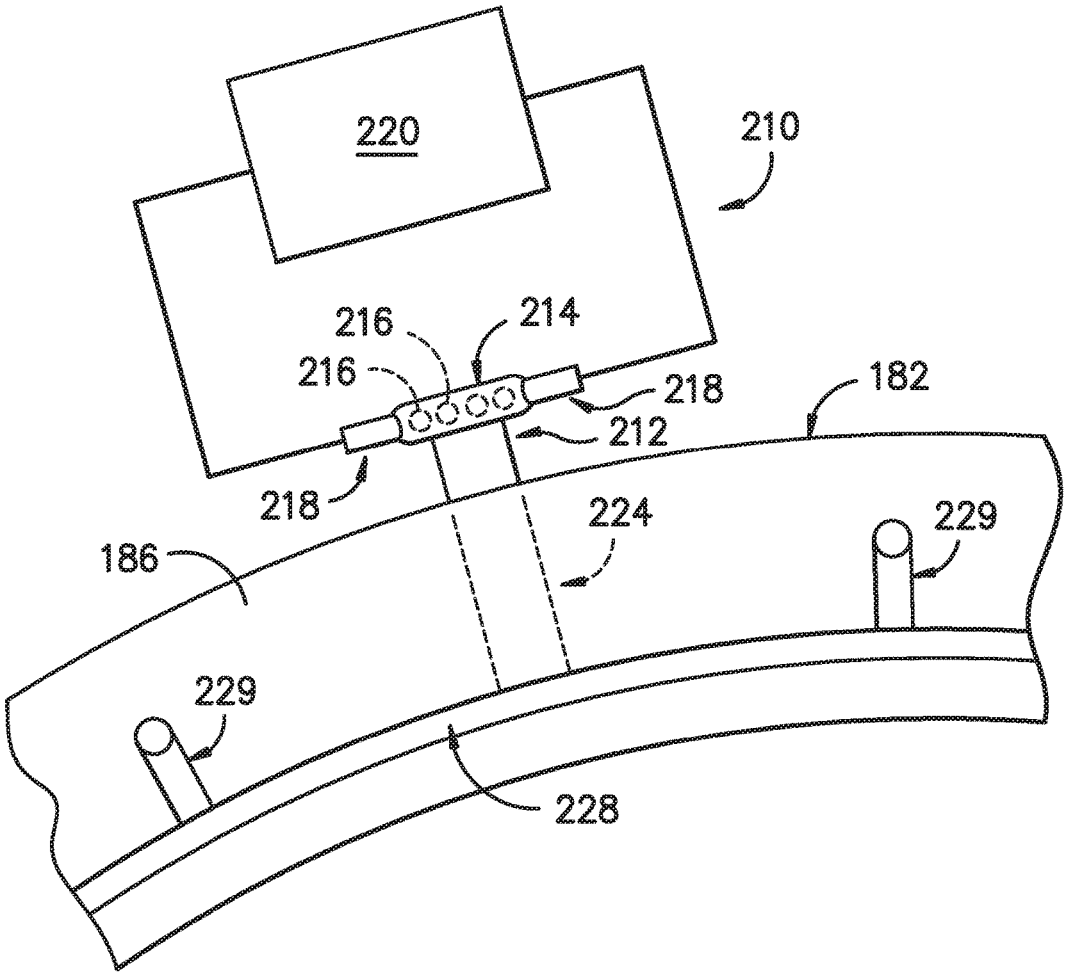
FIG. 12 is a cross-sectional view of a support ring assembly according to embodiments of the present disclosure.
Figure 13:
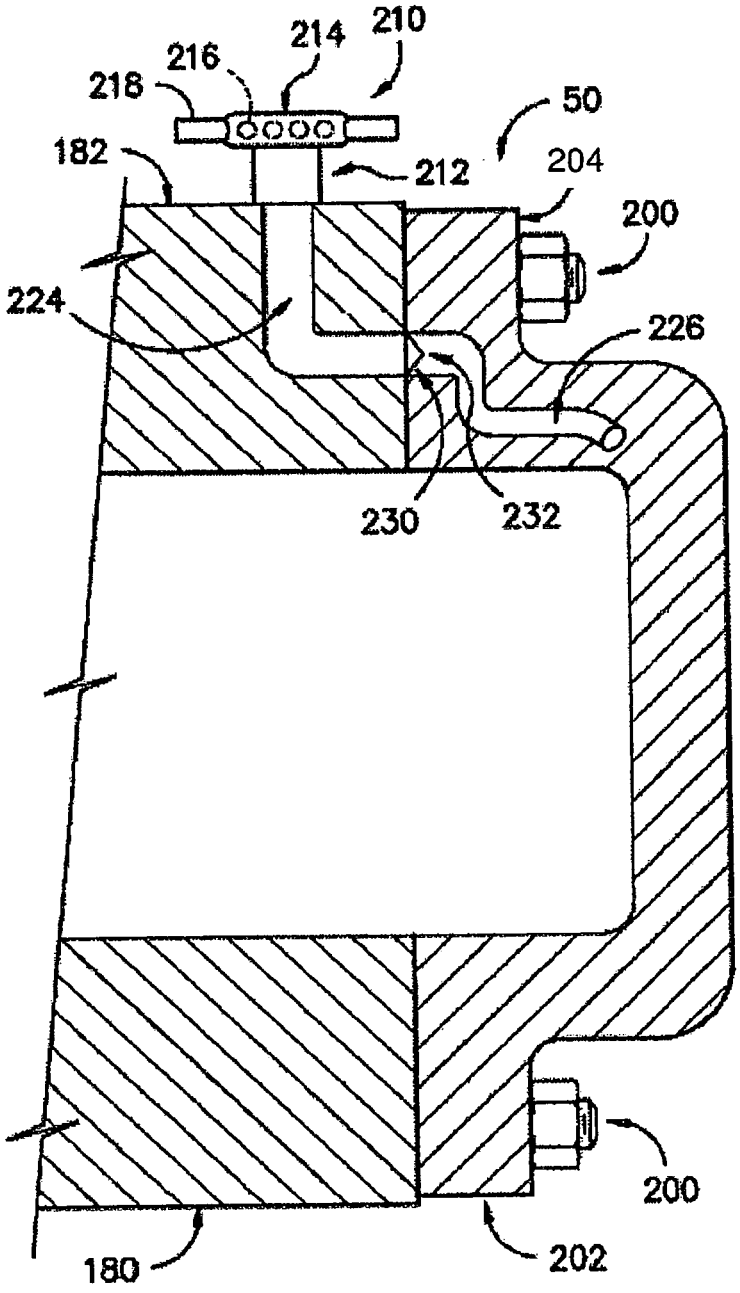
FIG. 13 is a cross-sectional view of a transition duct connected to a support ring assembly according to embodiments of the present disclosure.
Figure 14:
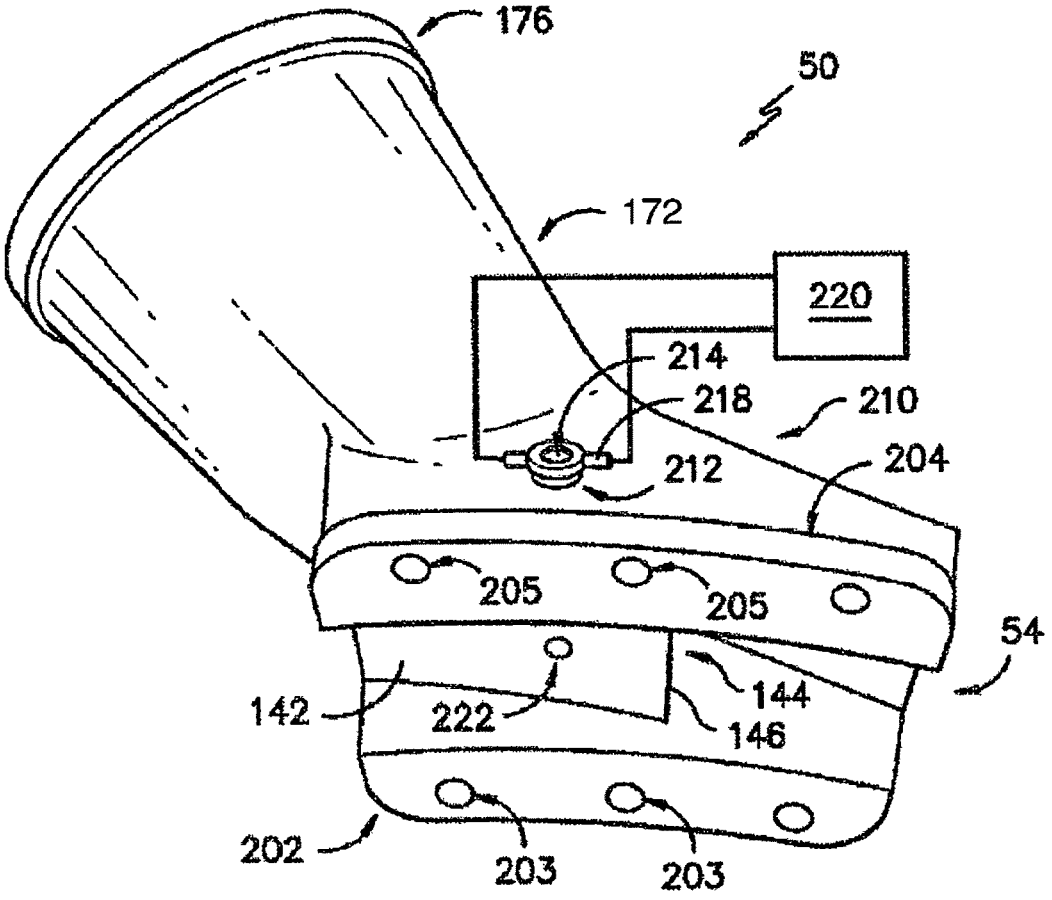
FIG. 14 is a front perspective view of a downstream portion of a transition duct according to embodiments of the present disclosure.

In some embodiments, as illustrated in FIGS. 14 and 15, an inlet tube 212 may be disposed upstream of the outlet 54 of one or more associated transition ducts 50, such as proximate passage 56. Alternatively, as illustrated in FIGS. 9, 12 and 13, an inlet tube 212 may be disposed downstream of the outlet 54 of one or more associated transition ducts 50, such as proximate support ring assembly. To flow injection fluid from inlet tube 212 to and through outlet 222, the inlet tube 212 may be in fluid communication with various conduits which may extend through one or more transition ducts 50 and/or the support ring assembly (such as the upper support ring 182 as shown or lower support ring 180). A conduit and inlet tube 212 may be portions of a singular tube, or may be separate components that are in fluid communication. For example, in the embodiments of FIGS. 14 and 15, late injection assembly 210 further includes a conduit which extends through and/or is defined in a transition duct 50, such as in the passage 56 and/or various interior surfaces, and the injection fluid flows from the inlet tube 212 through the conduit and is exhausted from the conduit through the outlet 222 into the interior 57. In the embodiments illustrated in FIGS. 9, 12 and 13, late injection assembly 210 further includes a first conduit 224 and a second conduit 226 which are in fluid communication with each other. First conduit 224 extends from and is in fluid communication with inlet tube 212, and extends through and/or is defined in the support ring assembly (such as the upper support ring 182 as shown or lower support ring 180). The second conduit 226 extends through and/or is defined in a transition duct 50, such as in the passage 56 and/or various interior surfaces. Injection fluid flows from the inlet tube 212 through the first conduit 224 and from the first conduit 224 through the second conduit 226 and is exhausted from the second conduit 226 through the outlet 222 into the interior 57.

In some embodiments, as illustrated in FIG. 13, the first conduit 224 and second conduit 226 may be in direct fluid communication, such that injection fluid flows directly from the first conduit 224 into the second conduit 226. For example, the first conduit 224 and second conduit 226 may be directly coupled via a male feature 230 of the first conduit 224 (as shown) or second conduit 226 and a female feature 232 of the second conduit 226 (as shown) or first conduit 224, or via another suitable connection. In alternative embodiments, as illustrated in FIG. 12, the first conduit 224 and second conduit 226 may be in indirect fluid communication. For example, a manifold 228 may be defined in the support ring assembly (such as the upper support ring 182 as shown or lower support ring 180). The manifold 228 may be annular and/or arc-shaped, or may have any other suitable shape. Manifold 228 may advantageously distribute the injection fluid to one or more of the transition ducts 50. For example, manifold 228 may be in fluid communication between one or more first conduits 224 and one or more second conduits 226. Distribution conduits 229 may be defined in fluid communication between the manifold 228 and the second conduits 226. Injection fluid may thus flow from the first conduit(s) 224 into the manifold 228, and from the manifold 228 into the second conduit(s) 226 (such as via distribution conduits 229), and from the second conduit(s) 226 through outlet(s) 222 into the interiors 57 of one or more transition ducts 50. An associated distribution conduit 229 and second conduit 226 may be directly coupled via a male feature of the distribution conduit 229 or second conduit 226 and a female feature of the second conduit 226 or distribution conduit 229, or via another suitable connection.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbomachine comprising:

a plurality of transition ducts disposed in a generally annular array and comprising a first transition duct and a second transition duct, each of the plurality of transition ducts comprising an inlet, an outlet, and a passage defining an interior and extending between the inlet and the outlet and defining a longitudinal axis, a radial axis, and a tangential axis, the outlet of each of the plurality of transition ducts offset from the inlet along the longitudinal axis and the tangential axis;

a support ring assembly downstream of the outlet of each of the plurality of transition ducts along a hot gas path, the support ring assembly defining a transition between the outlet of each of the transition ducts and a first stage bucket assembly and further defining an injection fluid flow passage therethrough;

a plurality of mechanical fasteners connecting each transition duct of the plurality of transition ducts to the support ring assembly; and a late injection assembly disposed radially outward of the support ring assembly and providing fluid communication for an injection fluid to flow through the injection fluid flow passage into the interior of at least one transition duct of the plurality of transition ducts, wherein an outlet of the late injection assembly is defined downstream of a choke plane defined in the interior of the at least one transition duct.

2. The turbomachine of claim 1, wherein the late injection assembly comprises an inlet tube and a fuel port providing fluid communication for flowing a fuel into the inlet tube.

3. The turbomachine of claim 2, wherein the late injection assembly further comprises a fuel conduit in fluid communication with the inlet tube through the fuel port.

4. The turbomachine of claim 2, wherein an inlet of the inlet tube is configured to flow a working fluid into the inlet tube.

5. The turbomachine of claim 2, wherein the flow passage through the support ring assembly comprises a first conduit; and wherein a second conduit extending extends through the transition duct, the first conduit being in fluid communication with the second conduit.

6. The turbomachine of claim 5, wherein the first conduit and the second conduit are in direct fluid communication.

7. The turbomachine of claim 5, wherein the flow passage through the support ring assembly further defines a manifold, the manifold being disposed in fluid communication between the first conduit and the second conduit.

8. The turbomachine of claim 1, wherein an inner surface of the at least one transition duct at least partially defines a trailing edge, and wherein the outlet of the late injection assembly is defined in the trailing edge.

9. The turbomachine of claim 1, wherein an inner surface of the at least one transition duct at least partially defines a pressure side and a suction side, and wherein the outlet of the late injection assembly is defined in one of the pressure side or the suction side.

10. The turbomachine of claim 1, wherein the outlet of each of the plurality of transition ducts is further offset from the inlet along the radial axis.

11. The turbomachine of claim 1, further comprising a turbine section in communication with plurality of transition ducts, the turbine section comprising the support ring assembly and the first stage bucket assembly.

12. The turbomachine of claim 11, wherein no nozzles are disposed upstream of the first stage bucket assembly.

13. A turbomachine comprising:

a plurality of transition ducts disposed in a generally annular array and comprising a first transition duct and a second transition duct, each of the plurality of transition ducts comprising an inlet, an outlet, and a passage defining an interior and extending between the inlet and the outlet and defining a longitudinal axis, a radial axis, and a tangential axis, the outlet of each of the plurality of transition ducts offset from the inlet along the longitudinal axis and the tangential axis, the outlet of each of the plurality of transition ducts comprising a first mounting flange and a second mounting flange spaced from the first mounting flange along the radial axis;

a support ring assembly downstream of the outlet of each of the plurality of transition ducts along a hot gas path, the support ring assembly defining a transition between the outlet of each of the transition ducts and a first stage bucket assembly and further defining an injection fluid flow passage therethrough, the support ring assembly comprising an inner support ring and an outer support ring;

a plurality of mechanical fasteners connecting each transition duct of the plurality of transition ducts to the support ring assembly, at least a first mechanical fastener of the plurality of mechanical fasteners extending through the first mounting flange and the inner support ring and at least a second mechanical fastener of the plurality of mechanical fasteners extending through the second mounting flange and the outer support ring; and a late injection assembly disposed radially outward of the support ring assembly and providing fluid communication for an injection fluid to flow into the interior of at least one transition duct of the plurality of transition ducts, wherein an outlet of the late injection assembly is defined downstream of a choke plane defined in the interior of the at least one transition duct.

14. The turbomachine of claim 13, wherein an inner surface of the at least one transition duct at least partially defines a trailing edge, and wherein the outlet of the late injection assembly is defined in the trailing edge.

15. The turbomachine of claim 13, wherein an inner surface of the at least one transition duct at least partially defines a pressure side and a suction side, and wherein the outlet of the late injection assembly is defined in one of the pressure side or the suction side.

* * * * *